United States Patent [19]

Kashiwara et al.

[11] Patent Number: 5,051,651

[45] Date of Patent: Sep. 24, 1991

[54] IGNITION PLUG WITH A HOLLOW CYLINDRICAL GROUND ELECTRODE AND AN IGNITION PROCESS BY THE USE THEREOF

[75] Inventors: Ryohei Kashiwara, Sakai; Hideaki Kashiwara, Kyoto; Hidehiko Noguchi; Takeaki Kashiwara, both of Osaka, all of Japan

[73] Assignee: Tadaharu Fujiwara, Osaka, Japan

[21] Appl. No.: 409,347

[22] Filed: Sep. 19, 1989

[30] Foreign Application Priority Data

Nov. 24, 1988 [JP] Japan ..... 63-296924
Feb. 8, 1989 [JP] Japan ..... 1-29174

[51] Int. Cl.[5] ..... H01T 13/32

[52] U.S. Cl. ..... 313/139; 313/141; 313/143

[58] Field of Search ..... 313/138-141, 313/143, 618, 142

[56] References Cited

U.S. PATENT DOCUMENTS 2,208,667 7/1940 Devine ..... 313/141
3,229,139 1/1966 Watson ..... 313/141
3,315,925 6/1970 Rickley ..... 313/139
4,028,576 6/1977 Wolfsey ..... 313/138 X

FOREIGN PATENT DOCUMENTS 167687 1/1986 European Pat. Off. ..... 313/139
52-1243 1/1977 Japan ..... 313/141

*Primary Examiner*—Donald J. Yusko
*Assistant Examiner*—Michael Horabik
*Attorney, Agent, or Firm*—Fisher, Christen & Sabol

[57] ABSTRACT

An ignition plug with a hollow cylindrical ground electrode, in which the center of a hollow cylindrical ground electrode is faced to the top of a center electrode, supported by a pair of stays, with a spark gap put in between so that the axial line of the center electrode and the axial line of a cylindrical hole of the ground electrode can fall on the same line and the sum of the center electrode's radius and the spark gap can be nearly equal to the radius of the cylindrical hole of the ground electrode. The model can be modified in various ways to increase the propagation speed of ignition and augment the power of expanding combustion gas.

19 Claims, 16 Drawing Sheets

IGNITION PLUG WITH A HOLLOW CYLINDRICAL GROUND ELECTRODE AND AN IGNITION PROCESS BY THE USE THEREOF

BACKGROUND OF THE INVENTION

1. Field of the Invention

The invention relates to an ignition plug for use in the internal combustion engines of automobiles and the like, and a process for instantaneously igniting the gas mixture in a combustion chamber thereof.

2. Background Art

So far, as disclosed in Japanese Published Patent Application No. 62-11471, an art to accelerate the ignition propagation of gas mixture in a combustion chamber in the early stage of ignition was developed by the present inventors, in which an ignition groove was provided on the piston side of a ground electrode in order that the gas mixture in the small cavity of the ignition groove may be ignited as early as possible To be more exact, in the art, the end of the ignition groove is open toward a cylindrical center electrode with a spark gap put in between, so that ignition seeds that appear in the spark gap radially bounce on the center electrode and only a few of them can effectively ignite the gas mixture in the ignition groove. Thus, the problem is that with the ignition plug, the time from the appearance of ignition seeds to the combustion of gas mixture in the ignition groove cannot be reduced any more. The situation being such that, as shown in Japanese Published Patent Application No. 62-321045, an ignition groove was provided to on the top of a center electrode, and a ground electrode was opposed to the ignition groove in such a way as to cover it up against a piston placed ahead of the center electrode. With this improvement, the time to ignite gas mixture in the ignition groove was certainly able to be reduced as anticipated; however, since the ground electrode and the ignition groove are put parallel to each other, ignition seeds have to travel as much as the length of the ignition groove is increased to ignite the gas mixture at the end of the ignition groove. Contrary to this, it is unavoidable that the capacity of the ignition groove to hold the gas mixture lessens as much as the length thereof is reduced.

BROAD DESCRIPTION OF THE INVENTION

According to the invention, however, a ground electrode is made into a hollow cylindrical form so that a center electrode can communicate with a piston placed ahead through the cylindrical hole in which the gas mixture can be collected, the axial line of the cylindrical hole of the ground electrode can fall on the axial line of the center electrode, and the sum of the radius of the center electrode and a spark gap can be nearly equal to the radius of the cylindrical hole of the ground electrode, in which the spark gap is formed between the edge on the top of the center electrode and the edge on the circumference of the cylindrical hole of the ground electrode. The form of the ground electrode and the spatial relation of the two electrodes are such that once sparks appear in the spark gap, the ignition of gas mixture takes place in the cylindrical hole of the ground electrode, and combustion gas gushes out therefrom toward the piston like a projected bullet because one end of the cylindrical hole is almost wholly closed by the top of the center electrode. Therefore, the time from the appearance of ignition seeds to the combustion of the entire gas mixture can be reduced to a greater extent with the invention device than with conventional ones by the effective utilization of ignition seeds multiplying in the cylindrical hole of the ground electrode. In the meantime, the capacity of the cylindrical hole to hold the gas mixture can readily be increased according to the invention if necessary, which is detailed later with reference to the Examples.

According to the above embodiment of the invention, an end of the cylindrical hole near the center electrode and the top surface of the center electrode are substantially flush with each other, and there is a spark gap between the edge on the top of the center electrode and the edge on the circumference of the cylindrical hole, so that the cylindrical hole can be used effectively for multiplying the ignition seeds; in other words, an ample space for collecting gas mixture can be provided to within the cylindrical hole even when the outer shape of the ground electrode has to be made small Likewise, according to the invention, the top portion of the center electrode can be put in the cylindrical hole of the ground electrode in such a way as to form an electrode and the inside surface of the cylindrical hole of the ground electrode. By providing an inter-surface spark gap in this manner, sparks can appear in a wider region, and this lessens the local wearing off of both of the electrodes.

According to the invention, the capacity of the cylindrical hole of the ground electrode can be increased in such a way as to hold more of the gas mixture by whittling the inside of the cylindrical hole in the direction perpendicular to the axial line of the center electrode, by which, even though the thickness of the ground electrode along the axial line of the center electrode is small, an ample space to let a good number of ignition seeds grow in can be provided according to the size and the shape of a combustion chamber without sacrificing the capacity of the ignition plug of the invention.

According to the invention, on the piston side of the cylindrical hole a conical element can be provided for helping combustion gas to gush from the cylindrical hole, by which expanding combustion gas is well directed toward the piston side, and a steady ignition capacity is guaranteed with the different displacement of an ignition plug or the different type of gasoline to be used. According to the invention, an opening across the hollow cylindrical ground electrode can be provided, by which combustion gas can gush out from the cylindrical hole of the ground electrode not only toward the piston side but also in both of the directions perpendicular to the axial line thereof, and contributes to the increase of the propagation speed of ignition.

Accordingly, it is an object of the invention to provide a novel ignition plug for use in internal combustion engines of automobiles and the like by radically changing the conventional conception that has been liable to give less importance to the shape of the ground electrode.

BRIEF DESCRIPTION OF THE INVENTION

The above and other objects and features of the invention appear more fully hereinafter from a consideration of the following description taken in connection with the accompanying drawings, in which.

DETAILED DESCRIPTION OF THE INVENTION

In order that the invention may be understood more clearly, it will now be described with reference to the attached drawing.

Figure 1:
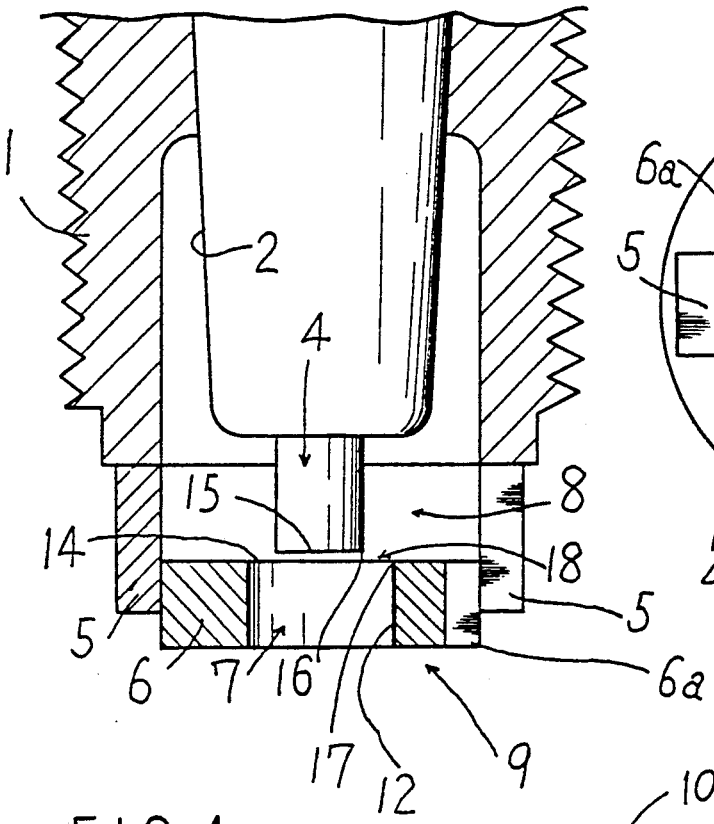
FIGS. 1, 3 and 4 are, respectively, an elevational view, a bottom view, and a partially enlarged side view of the top portion of an ignition plug in the first example of the invention.
Figure 3:
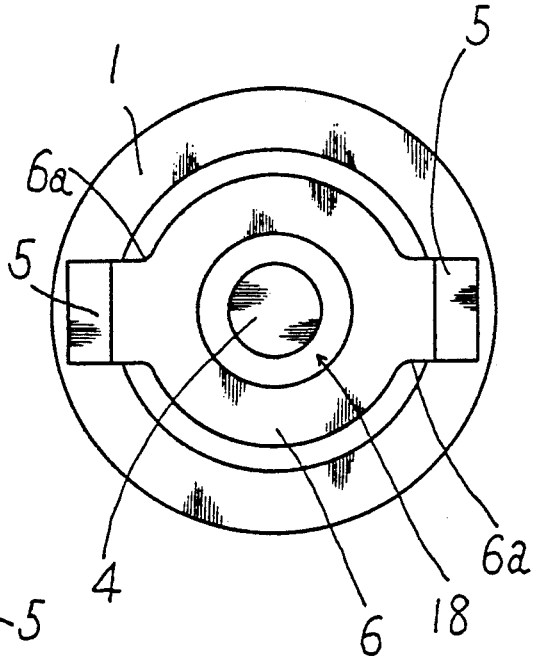
Figure 4:
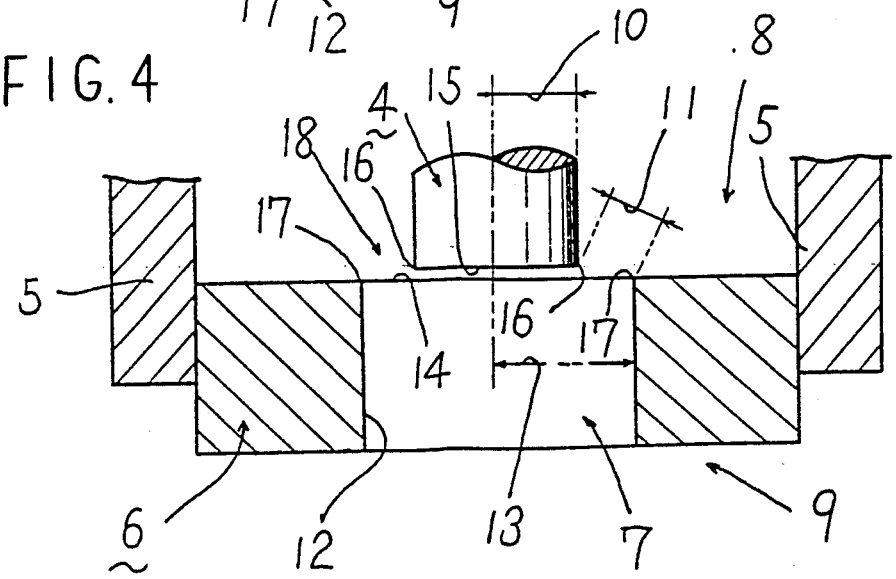
Figure 2:
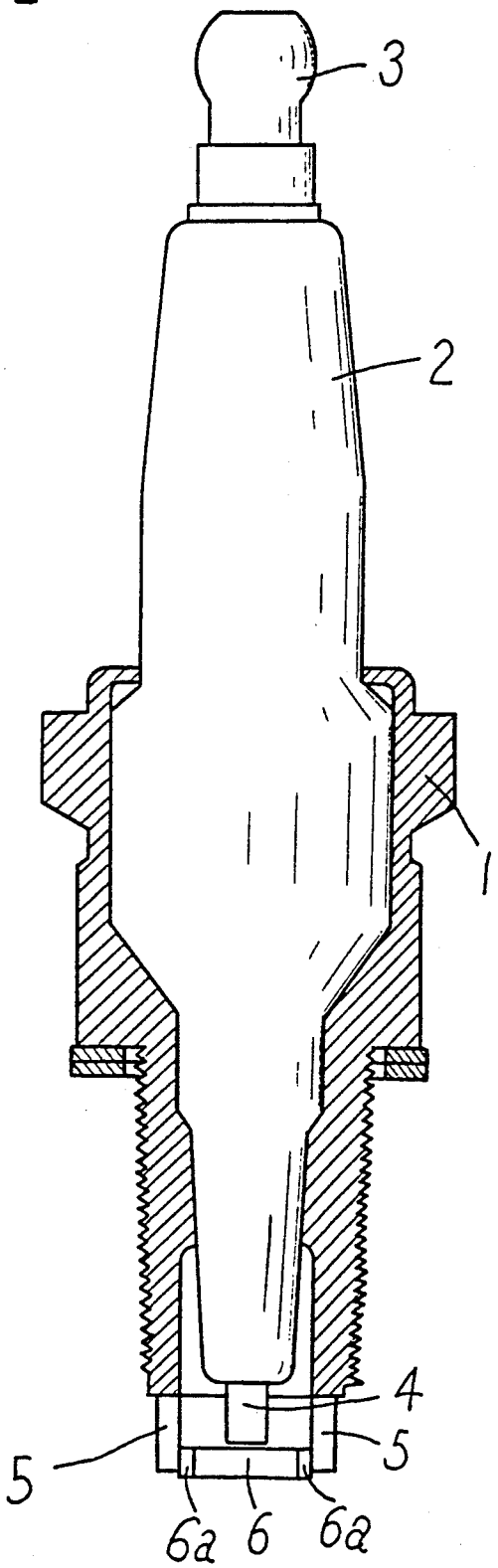
FIG. 2 is a whole elevational view of an ignition plug of which the top portion is to be provided with various ground electrodes according to the invention.

As seen in FIGS. 1 through 4, an ignition plug is constructed essentially of a center and a ground electrode. The center electrode 4 and a terminal 3 are connected to each other with lead in a porcelain insulator 2, while the ground electrode 6 is connected, at a pair of ears 6*a*, 6*a* on both sides, to a metal casing 1, electric conductor, on the porcelain insulator by way of a pair of stays 5, 5. Thus, the two electrodes are electrically separated. More particularly, as shown in FIGS. 1, 3 and 4, the outside of the ground electrode 6 is welded to the stays 5, 5 at the ears 6*a*, 6*a*, and the inside thereof forms a cylindrical hole 7 for collecting a plentiful amount of the gas mixture. Thus, the center electrode 4 communicates with the piston side 9 through the cylindrical hole 7, a tunnel, so to speak, of which one end 14 is open to the top 15 of the center electrode 4 on the spark side 8.

In the first example of the invention, the center electrode 4 and the ground electrode 6 are located so that the sum of the center electrode's radius 10 and the spark gap's span 11 can be nearly equal to the radius 13 of the cylindrical hole 7, extending from the axial line of the center electrode 4 to the inside surface 12 of the cylindrical hole, wherein the axial line of the center electrode 4 falls on the axial line of the cylindrical hole of the ground electrode 6, and the spark gap 18 spans the edge 16 on the top of the center electrode hole 7, and the top surface 15 of the center electrode and the opening 14 of the cylindrical hole on the spark side 8 is located nearly on the same plane.

In this example, the center and the ground electrodes are constructed and located such that sparks appear in the spark gap 18 between the edges 16 and 17, and become primary ignition seeds therein in such a way as to set the gas mixture on fire in the cylindrical hole 7 of which the capacity is the smallest of all of the other spaces in the combustion chamber. The combustion of the gas mixture works as secondary ignition seeds, and makes the whole of the remaining gas mixture explode in a moment.

When a combustion happens in the cylindrical hole 7, the secondary ignition seeds have to gush out from the cylindrical hole 7 toward the piston side 9 like a bullet because the other opening 14 is almost wholly closed by the top of the center electrode 4, which can effectively cause the remaining gas mixture to take fire.

Figure 5:
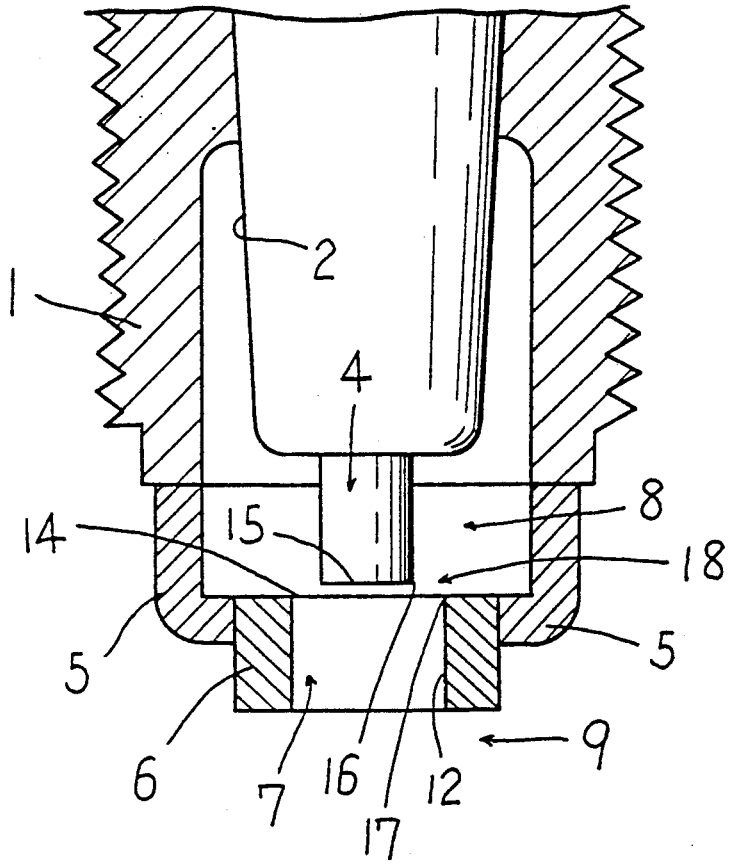
FIGS. 5 and 6 are, respectively, an elevational view and a bottom view of the top portion of an ignition plug in the second example, a variation of the first example of the invention.
Figure 6:
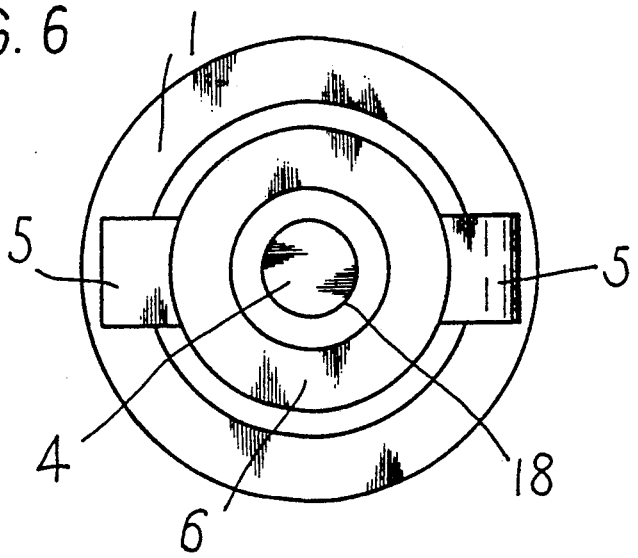

The first example can be modified as in the second example. As shown in FIGS. 5 and 6, a hollow cylindrical ground electrode 6, made of a piece of metal pipe sliced into an appropriate length, for instance, is welded to both of the free ends of inwardly bent stays 5, 5. With this modification, there can be produced the same effect as mentioned above.

Figure 7:
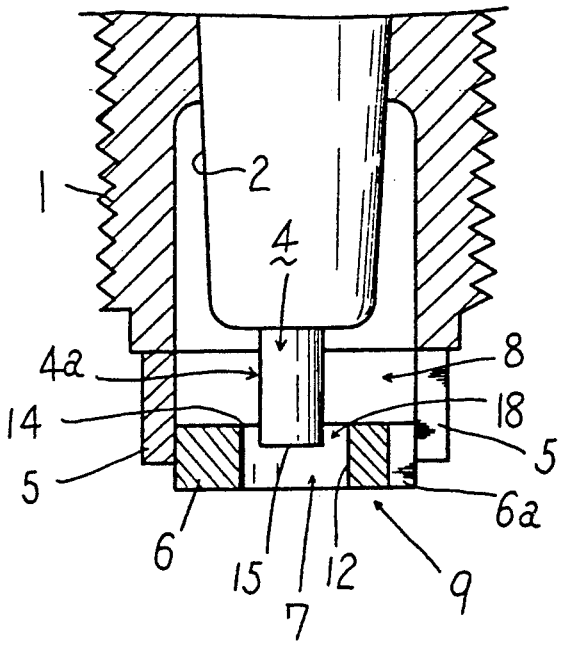
FIGS. 7, 8 and 9 are, respectively, an elevational view, a bottom view, and a partially enlarged side view of the top portion of an ignition plug in the third example, a variation of the first example of the invention.
Figure 8:
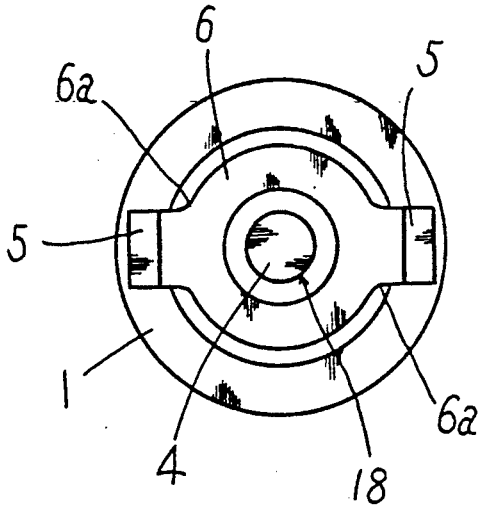
Figure 9:
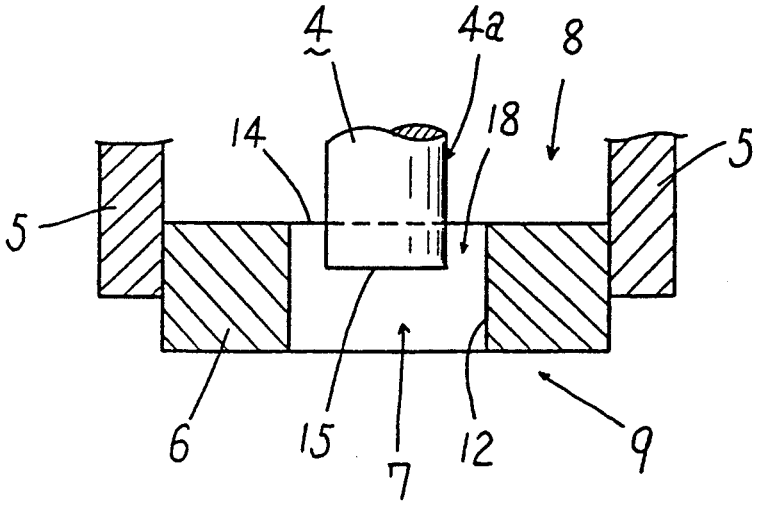

The first example can also be modified as in the third example. As shown in FIGS. 7, 8 and 9, the top portion of the center electrode 4 is put in the cylindrical hole 7 in such a way as to form a spark gap 18 between the side surface 4*a* of the center electrode 4 and the inside surface 12 of the cylindrical hole 7. In this example, there appear sparks between the two surfaces 4*a*, 12, so that both of the electrodes are not worn off as much by sparks as those in the preceding examples, and this contributes to prolonging their life In connection with the above, the result of a comparison test in terms of the fuel efficiency of the ignition plug of the third example and of a common one available in the market is given in Table 1. The comparison test was conducted under the following condition.

Truck used: ordinary truck with a 4 cylindered 1300 cc 4 cycle engine; test course: urban area of Osaka city; test speed: 40 to 50 km/h (max. 60 km/h); adjustment before test: ignition timing and amount of fuel to feed.

TABLE 1

| | Consumed fuel | Covered mileaqe | Fuel efficiency | Ratio of fuel eff. |
|---|---|---|---|---|
| Test plug | 12.9 L. | 113 km | 8.75 km/L. | 123 |
| Market plug | 16.1 L. | 114 km | 7.08 km/L. | 100 |

Figure 10:
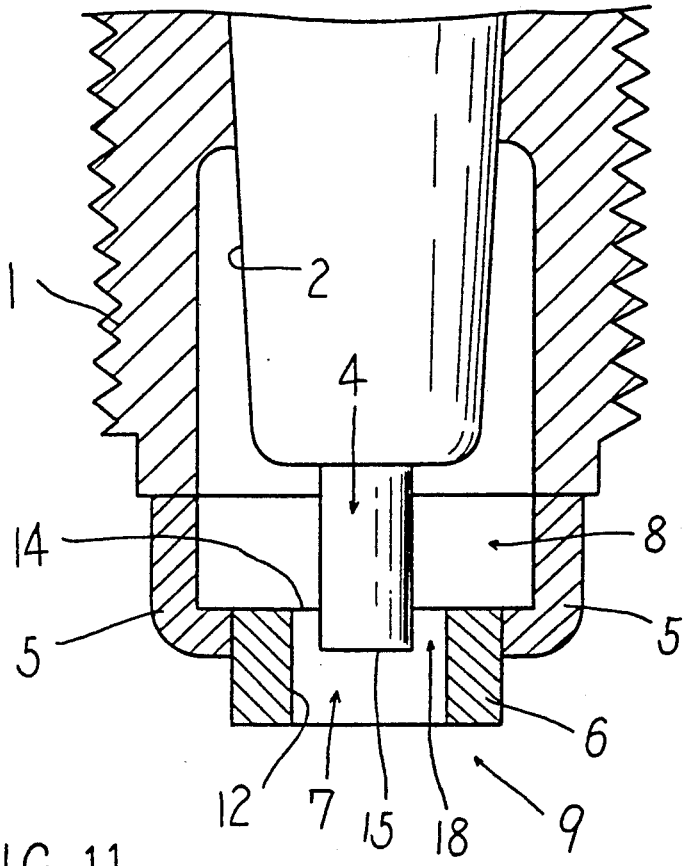
FIGS. 10 and 11 are, respectively, an elevational view and a bottom view of the top portion of an ignition plug in the fourth example, a variation of the third example.
Figure 11:
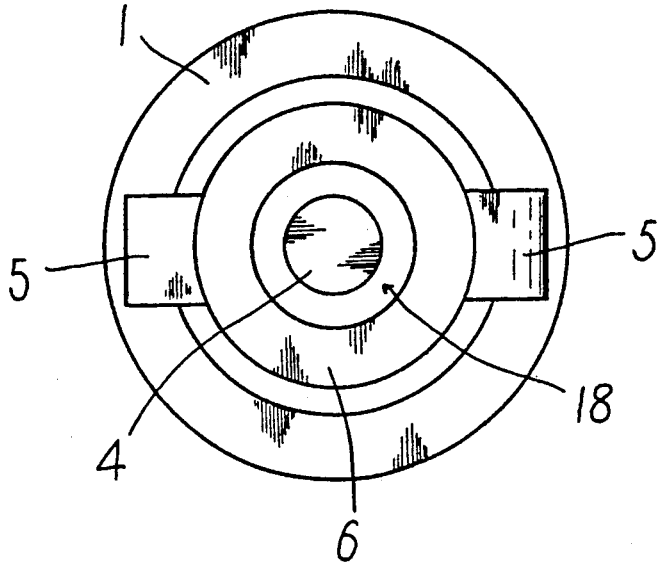

The third example can be modified as in the fourth example. As shown in FIGS. 10 and 11, a piece of metal pipe sliced into an appropriate length is used as a ground electrode 6. Both of the ends of the stays 5, 5 are inwardly bent into an L-form so as to weld them to the outside of the ground electrode 6.

Figure 12:
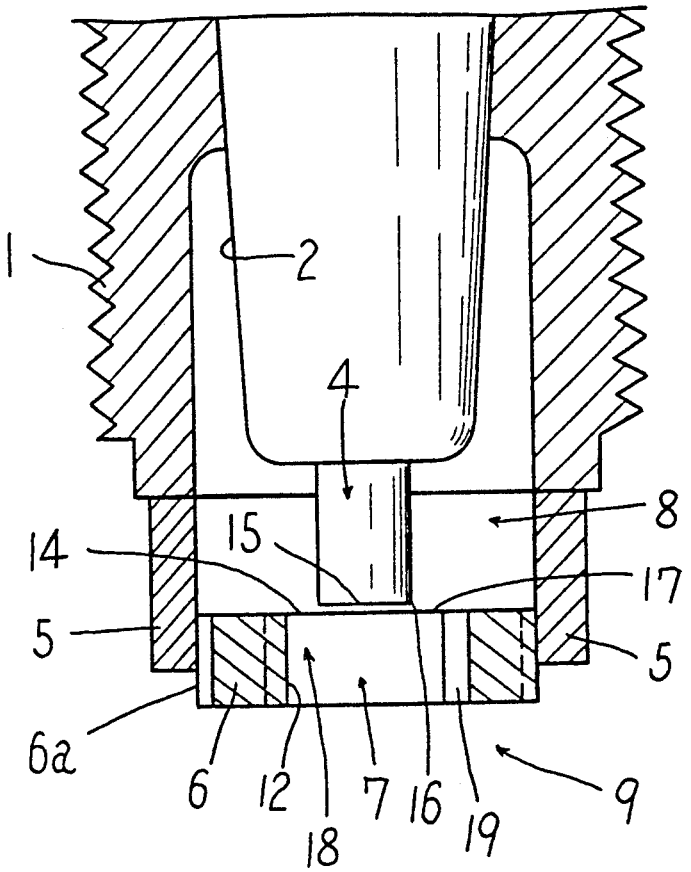
FIGS. 12 and 13 are, respectively, an elevational view and a bottom view of the top portion of an ignition plug in the fifth example, a variation of the first example of the invention.
Figure 13:
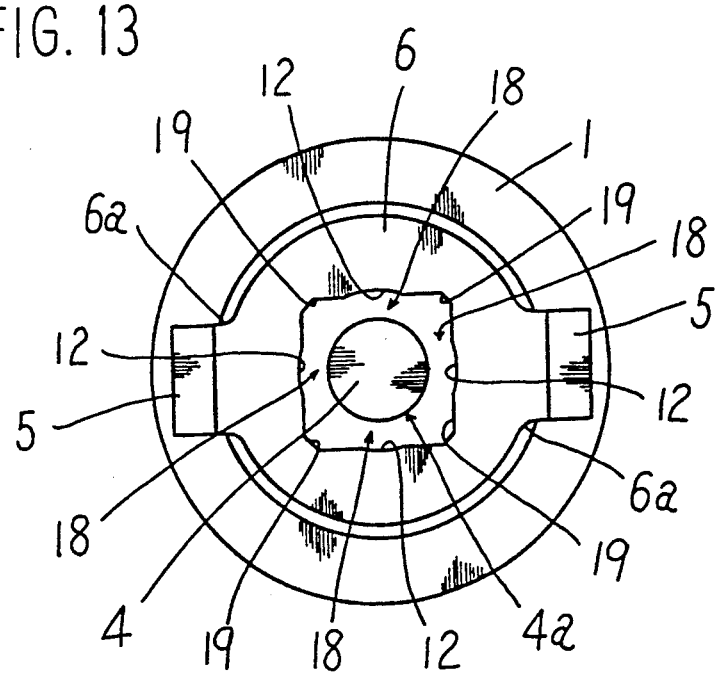

The fifth example can be derived from the first example. As shown in FIGS. 12 and 13, it is possible to increase the capacity of the cylindrical hole 7 by whittling the inside of that cylindrical hole into a cornered shape 19, by which even if the thickness of the ground electrode along the axial line has a limit per se, the capacity of the cylindrical hole 7 can be increased.

Figure 14:
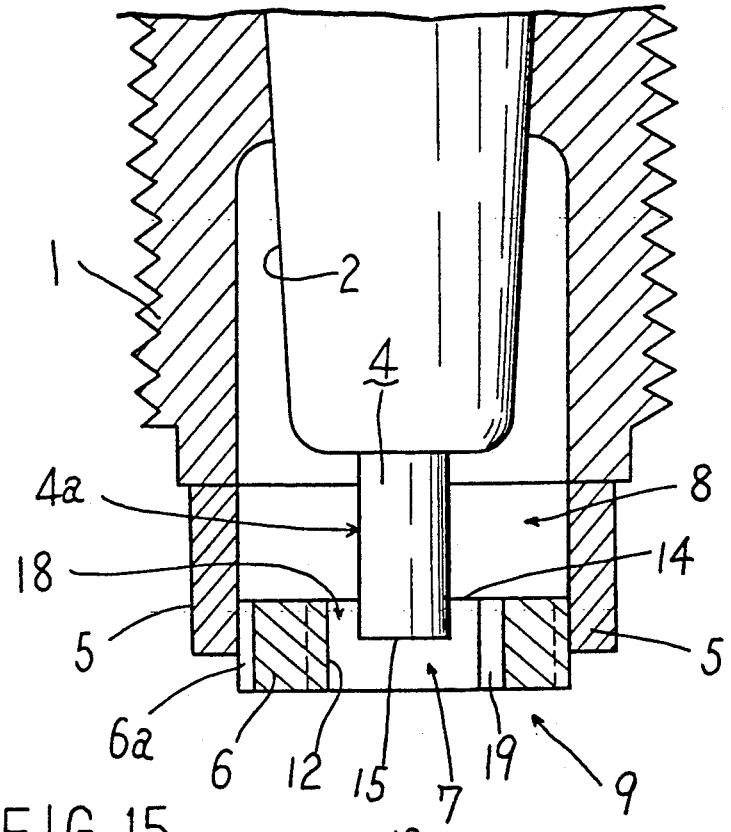
FIGS. 14 and 15 are, respectively, an elevational view and a bottom view of the top portion of an ignition plug in the sixth example, a variation of the fifth example of the invention.
Figure 15:
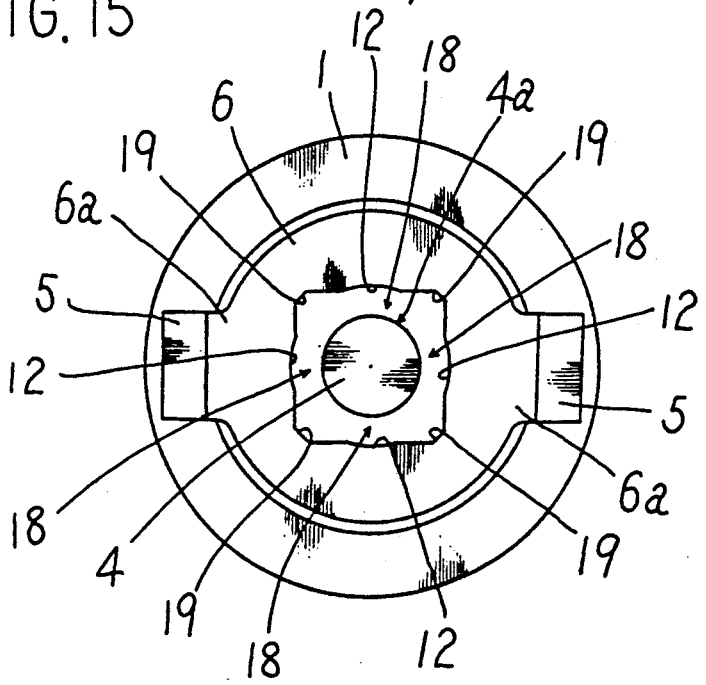

The sixth example, shown in FIGS. 14 and 15, is a variation of the fifth example. Since the top portion of the center electrode 4 is put in the cylindrical hole 7 of the ground electrode 6, there forms a spark gap 18 between the side surface of the center electrode 4 and the inside surface of the cylindrical hole 7. Such inter-surface spark gap prolongs the life of both of the electrodes much more by lessening their wearing off by sparks than the inter-edge spark gap formed between the edges 16, 17.

Figure 16:
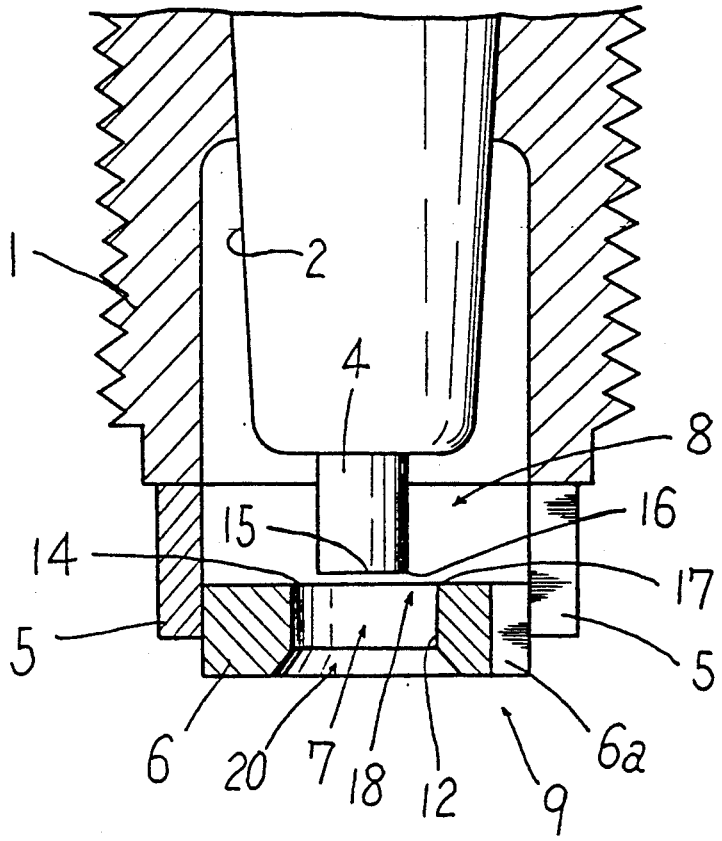
FIGS. 16 and 17 are, respectively, an elevational view and a bottom view of the top portion of an ignition plug in the seventh example, a variation of the first example of the invention.
Figure 17:
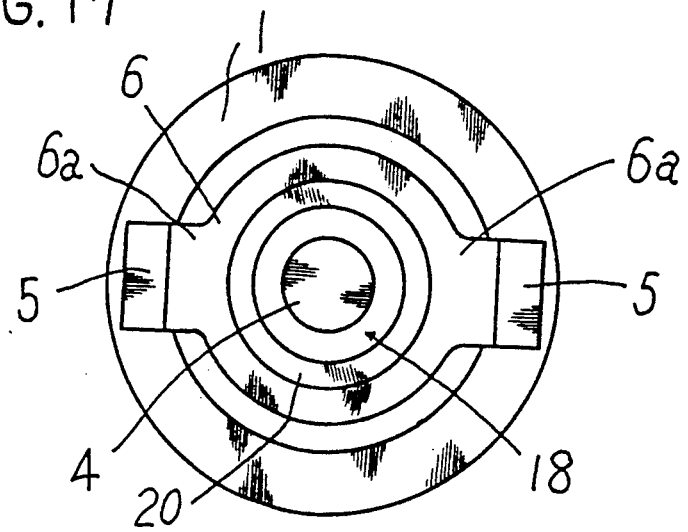

The seventh example, shown in FIGS. 16 and 17, is a variation of the first example. In order that ignition can propagate well, the end of the cylindrical hole 7 on the spark side 9 is widened into a conical form 20 with its wide bottom put toward the piston side. In this example, expanding combustion gas gushes from the cylindrical hole 7 of the ground electrode 6 by the guide of the conical opening 20 so as to ignite gas mixture outside of the cylindrical hole more effectively than in the first example, causing turbulent flow in the combustion chamber, because the other end of the cylindrical hole is almost blocked by the top of the center electrode 4.

Figure 18:
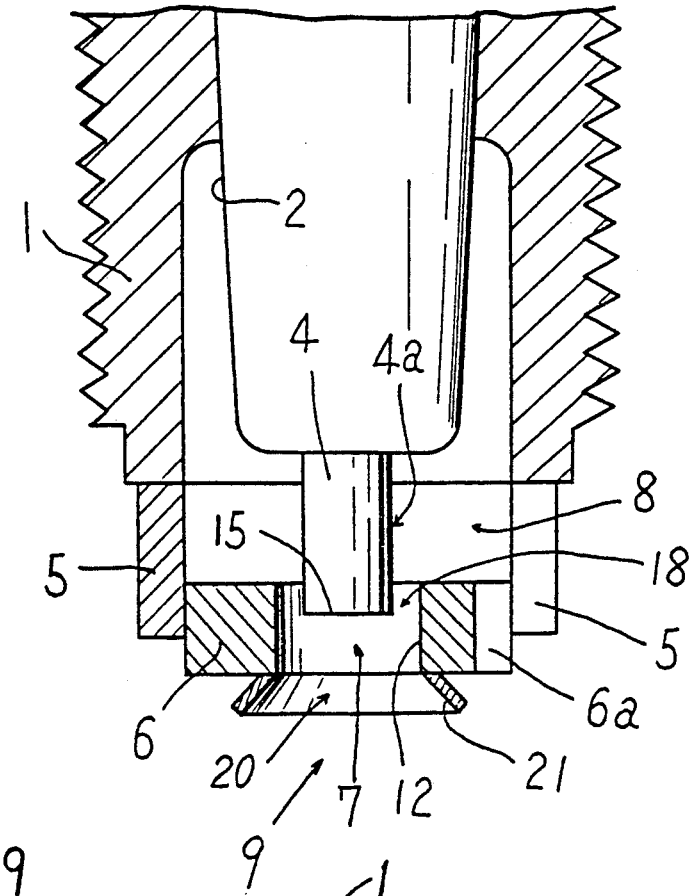
FIGS. 18 and 19 are, respectively, an elevational view and a bottom view of the top portion of an ignition plug in the eighth example, a variation of the seventh example of the invention.
Figure 19:
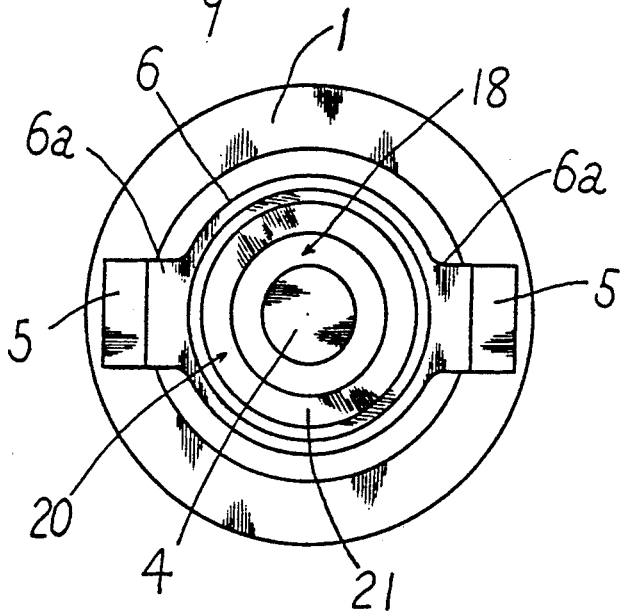

The eighth example, shown in FIGS. 18 and 19, is a variation of the seventh example. In this example, a guide 21 of a conical form is projectingly provided at the end of the cylindrical hole 7 of the ground electrode 6 on the piston side 9 by welding. With this device, the guide 21 can be formed into any size regardless of the shape of the ground electrode 6.

Figure 20:
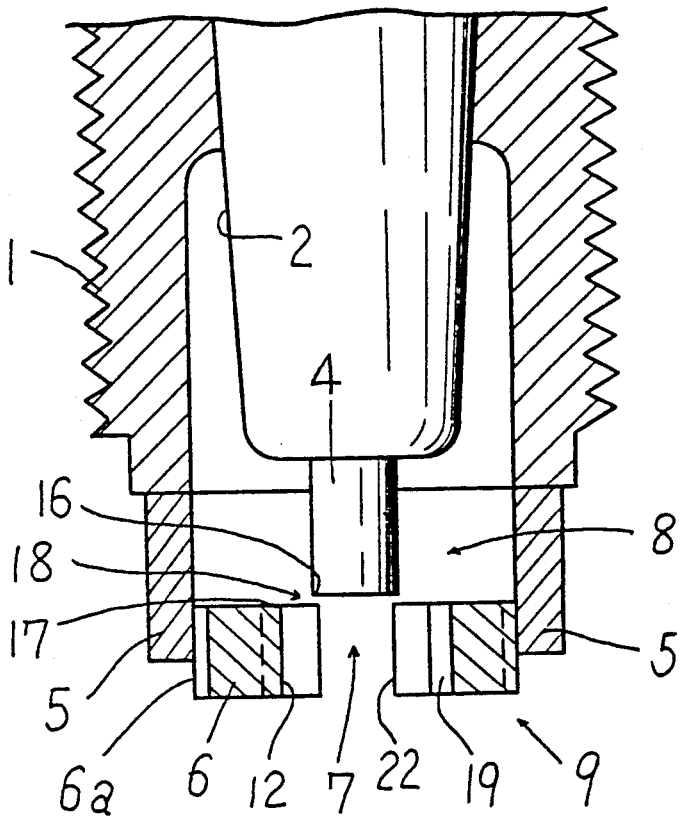
FIGS. 20 and 21 are, respectively, an elevational view and a bottom view of the top portion of an ignition plug in the ninth example, a variation of the first and the fifth examples of the invention.
Figure 21:
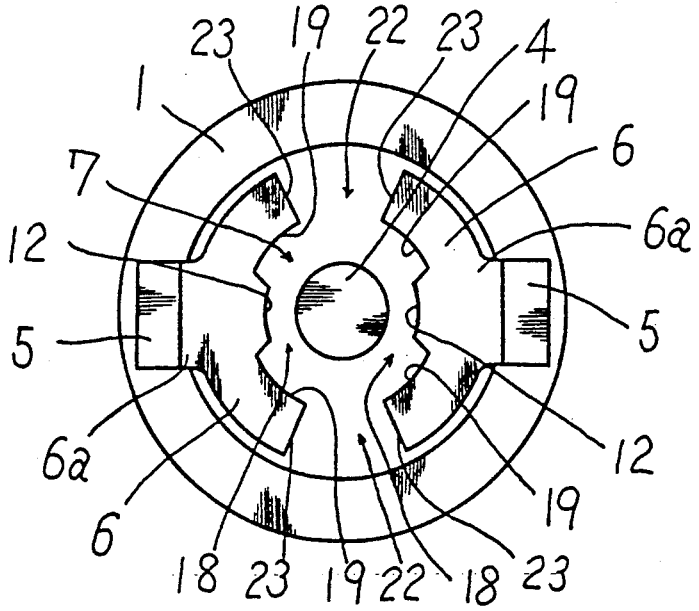

FIGS. 20 and 21 show the ninth example, a variation of the first and fifth examples. An opening 22 is provided to the cylindrical ground electrode 6 generally across the line connecting the paired stays 5, 5, respectively. With this device, the inside of the ground electrode communicates with not only the piston side 9 but also both of the lateral directions perpendicular to the axial line. Also, the inside wall of the ground electrode 6 can be whittled away 19 in such a way as to hold much more of the gas mixture. The openings 22 divide the cylindrical ground electrode 6 into two parts so that the ends of the respective parts can form V-shape with its pointed bottom side put inside. The structure is such that combustion gas can jet toward the piston side and toward both of the lateral sides perpendicular to the axial line of the center electrode 4, expanding in more than one direction.

Figure 22:
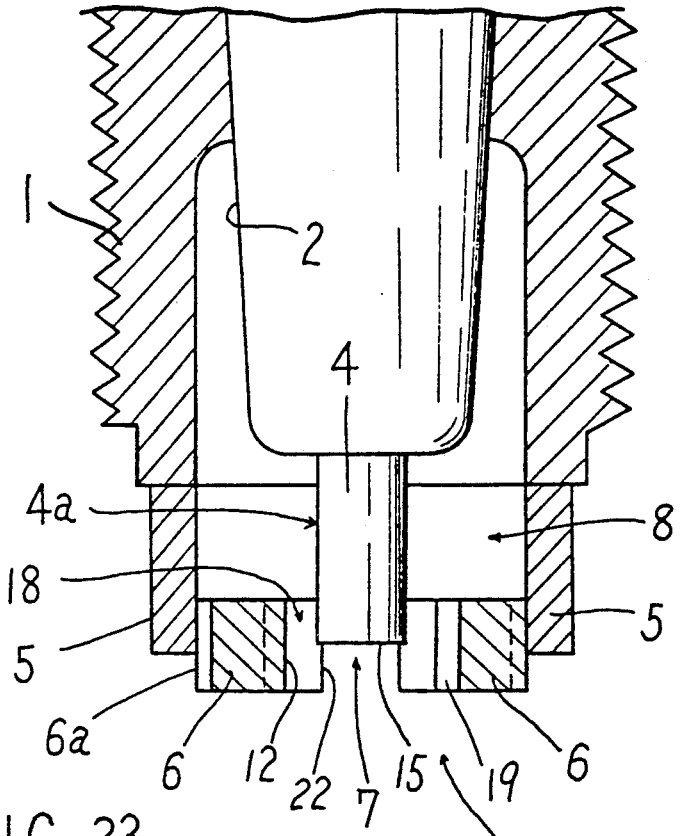
FIGS. 22 and 23 are, respectively, an elevational view and a bottom view of the top portion of an ignition plug in the tenth example, a variation of the ninth example of the invention.
Figure 23:
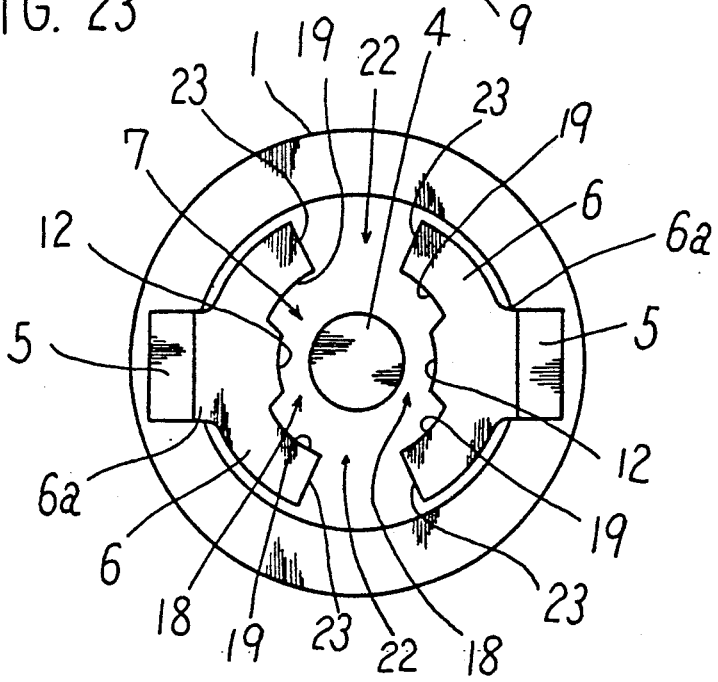

FIGS. 22 and 23 show the tenth example, a variation of the last example. The top portion of the center electrode 4 is put into a space 7 in the middle of the divided ground electrodes 6, 6. The spark gap 18 is formed between the side surface of the center electrode 4 and the inside surface of the ground electrodes 6, 6, so that sparks appear between the surfaces, which lessens the sparking chance per unit area on both of the electrodes, and prolongs their life.

Figure 24:
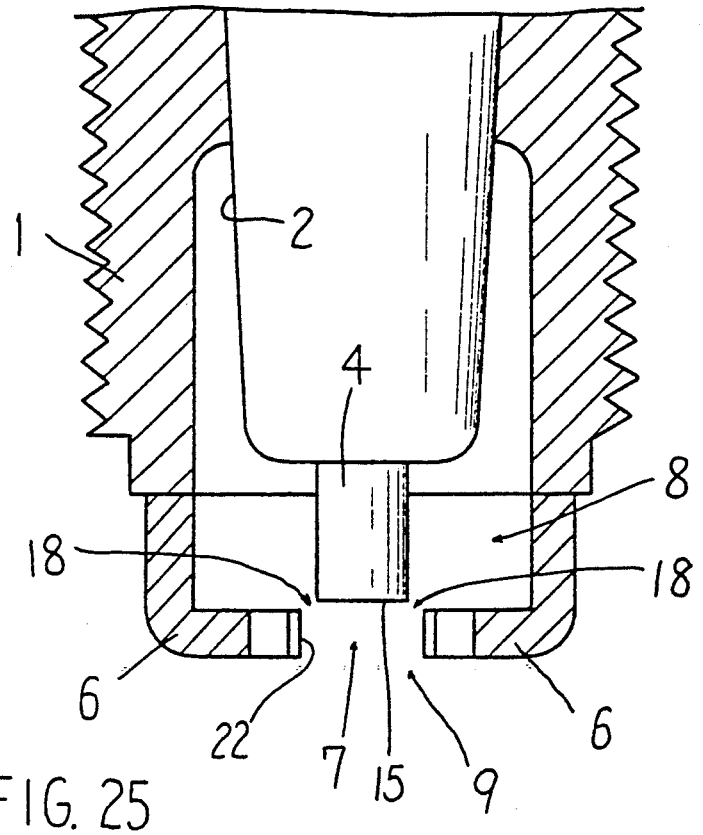
FIGS. 24 and 25 are, respectively, an elevational view and a bottom view of the top portion of an ignition plug in the eleventh example, a variation of the ninth example of the invention.
Figure 25:
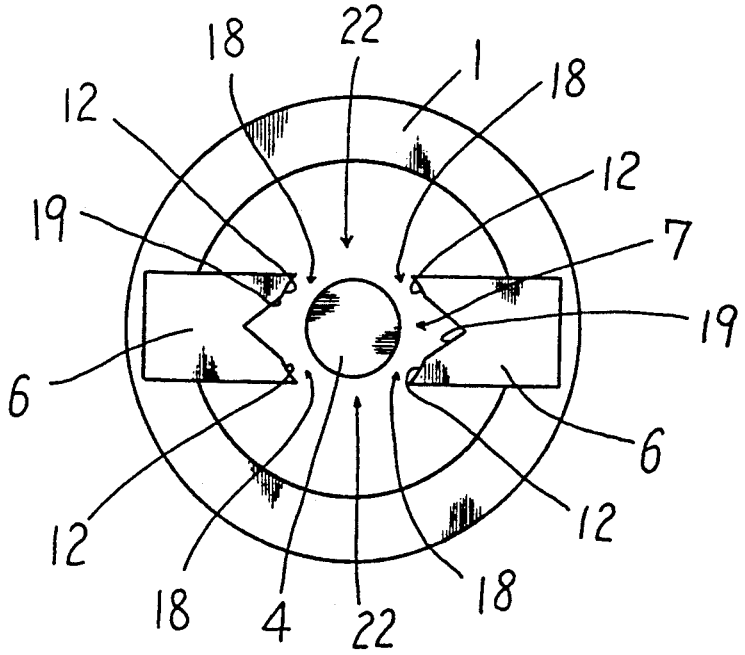

FIGS. 24 and 25 show the eleventh example, a variation of the ninth example. A pair of ground electrode 6, 6 are made from a pair of rectangular plates, and the ends of the ground electrodes 6, 6 facing the center electrode 4 are formed into a V-shape 19 with its opening put toward the center electrode 4 in such a way as to hold more of the gas mixture. The foot of the ground electrodes is welded to the metal casing 1.

Figure 26:
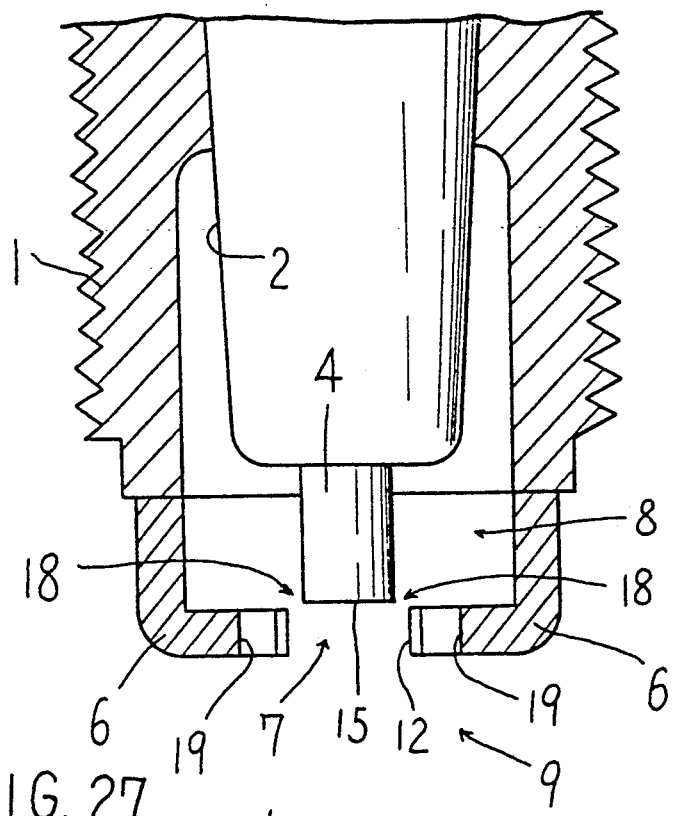
FIGS. 26 and 27 are, respectively, an elevational view and a bottom view of the top portion of an ignition plug in the twelfth example, a variation of the eleventh example of the invention.
Figure 27:
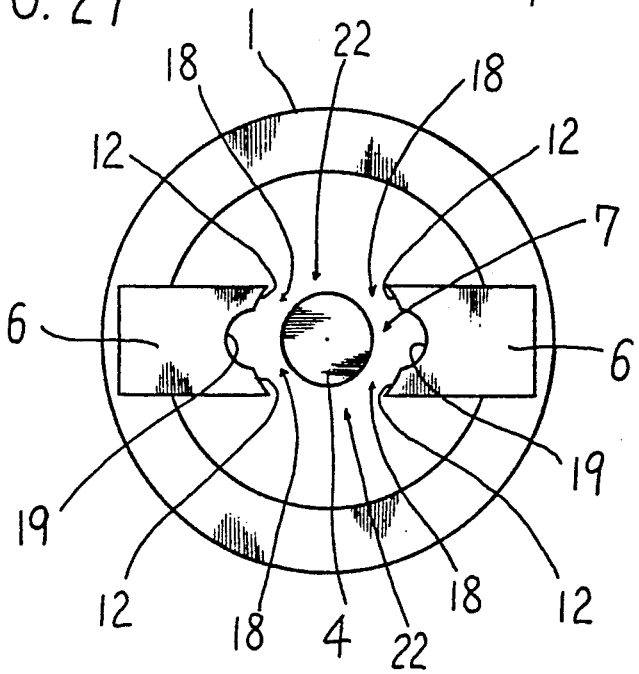

The twelfth example, shown in FIGS. 26 and 27, is a variation of the eleventh example. The ends of the ground electrodes facing the center electrode are notched into a V-shape in the last example, whereas they are formed into a semi-circular shape 19 in this example so as to hold more of the gas mixture.

Figure 28:
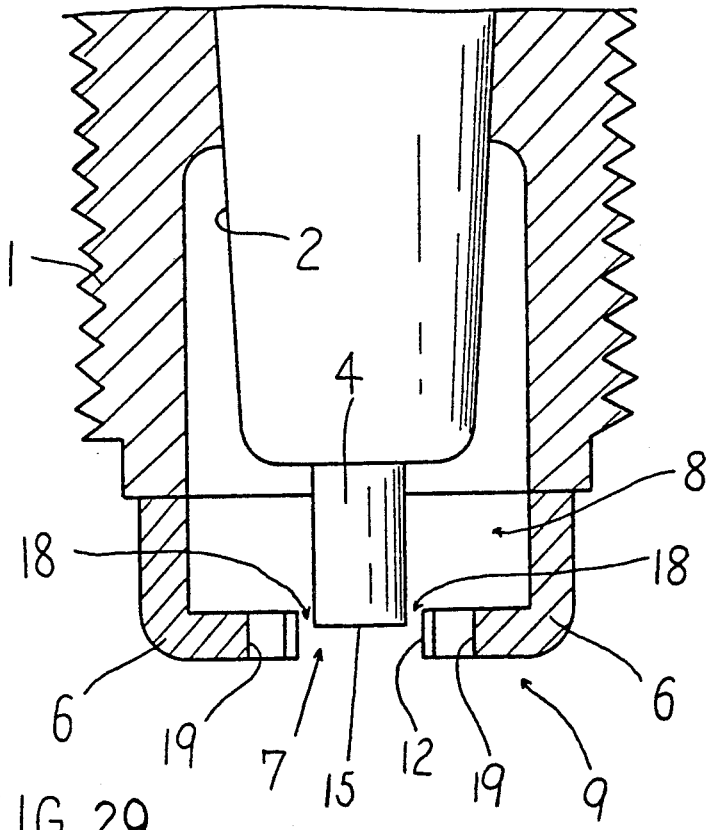
FIGS. 28 and 29 are, respectively, an elevational view and a bottom view of the top portion of an ignition plug in the thirteenth example, a variation of the eleventh example of the invention.
Figure 29:
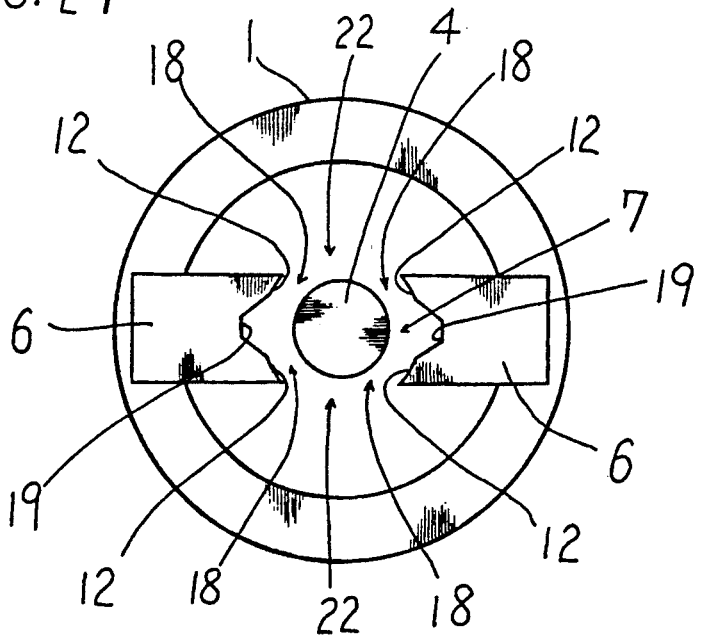

As can be seen in FIGS. 28 and 29, the thirteenth example is also a variation of the eleventh example. A cavity 19 to hold the gas mixture in is notched into a frustum shape, and the top portion of the center electrode 4 is put in between the paired ground electrodes 6, 6. Sparks appear between the side surface of the center electrode and the inside surface of the cavity 19 of the ground electrodes 6, 6; therefore, the wearing off of both of the center and the ground electrodes is diminished, and this prolongs their life.

Figure 30:
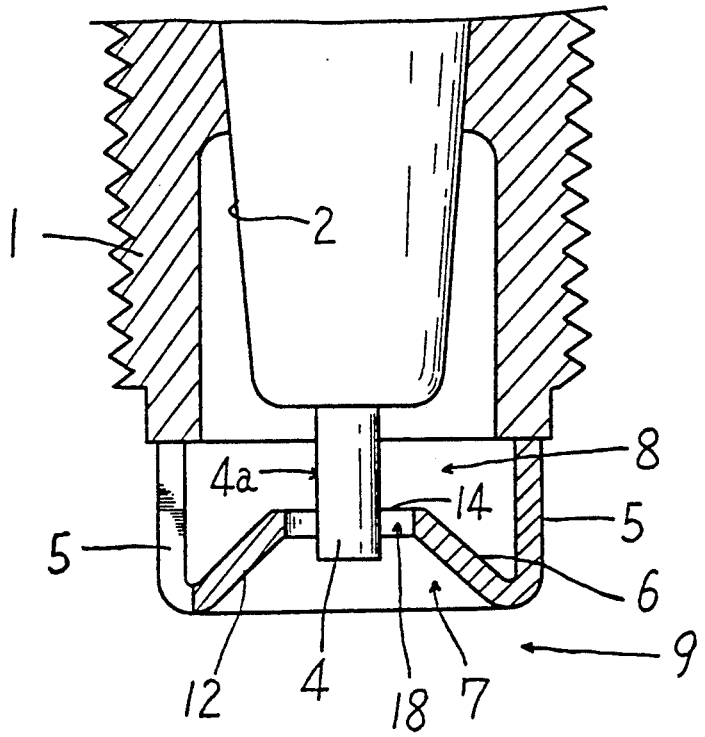
FIGS. 30 and 31 are, respectively, an elevational view and a bottom view of the top portion of an ignition plug in the fourteenth example, a variation of the third example of the invention.
Figure 31:
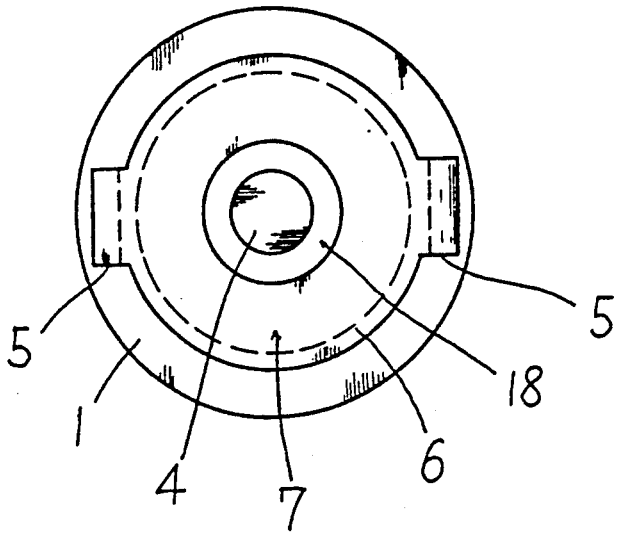

The fourteenth example, shown in FIGS. 30 and 31, is a variation of the third example. In order that the combustion gas can jet toward the piston side 9, the ground electrode 6 is formed into a truncated conical shape with its wide end put toward the piston side and with a hole in its center through which the top portion of the center electrode 4 projects. Sparks appear inside of the truncated conical shaped cavity 7 by which the gas mixture collected there is ignited, and combustion gas gushes toward the piston side 9 bouncing on the inclined surface 12 of the cavity.

Figure 32:
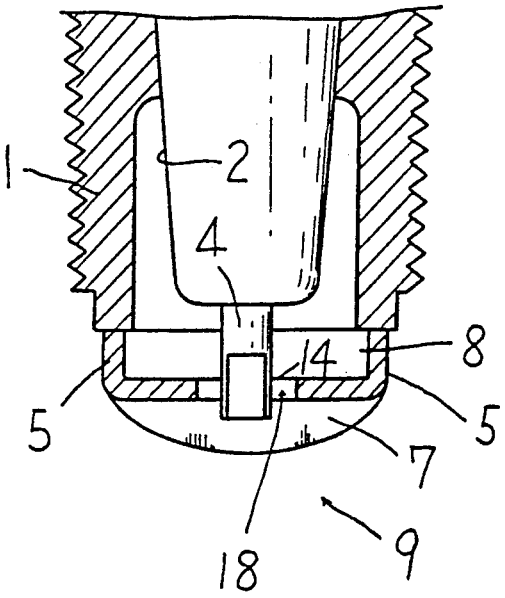
FIGS. 32, 33 and 34 are, respectively, an elevational view, side view, and a bottom view of the top portion of an ignition plug in the fifteenth example, a variation of the eighth, the ninth, and the fourteenth examples of the invention.
Figure 33:
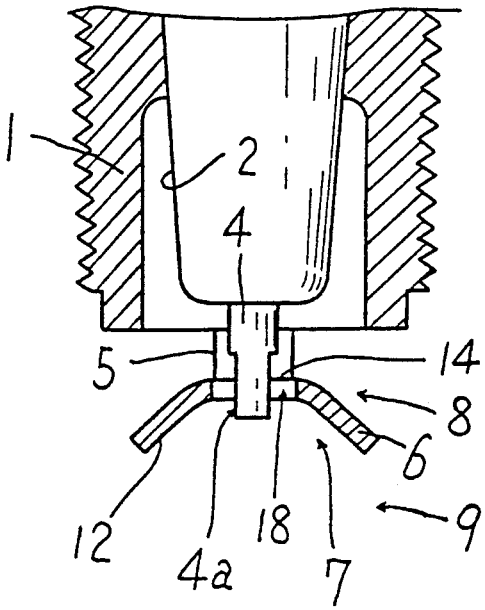
Figure 34:
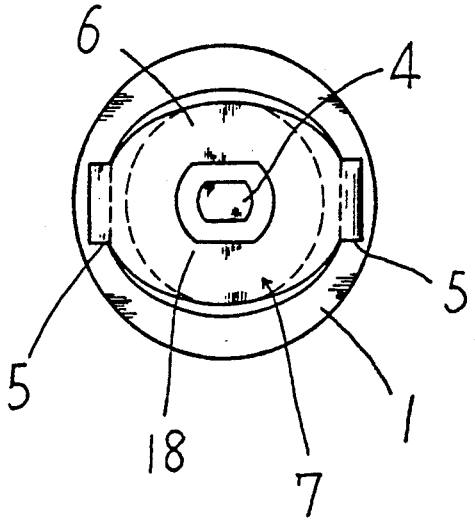

FIGS. 32 through 34 show the fifteenth example, a variation of the eighth, the ninth and the fourteenth examples. A cavity for collecting gas mixture 7 is formed into a roof shape with both of the ends of its ridge supported by a pair of stays 5, 5, with its wide bottom open toward the piston side 9, and with a hole in its center through which the top portion 4*a* of the center electrode 4 projects. The cavity of the ground electrode 6 is open to the piston side 9 and to the lateral sides perpendicular to the axial line of the center electrode, so that combustion gas can jet widely over the piston side 9.

As best seen from the above, according to this invention, the center of a hollow cylindrical ground electrode is faced to the top of a center electrode, supported by a pair of stays, with a spark gap put in between so that the axial line of the center electrode and the axial line of a cylindrical hole of the ground electrode can fall on the same line and the sum of the center electrode's radius and the spark gap can be nearly equal to the radius of the cylindrical hole of the ground electrode. The ignition plug of the invention has such structure that when sparks appear in the spark gap, gas mixture in the cylindrical hole is set on fire, and combustion gas gushes out from an end thereof toward the piston like a bullet, because the other end is almost wholly closed by the top of the center electrode. This remarkably strengthens the ignition propagation, forming bigger ignition seeds in a reduced time, whereby the time from the appearance of the first ignition to the completion of combustion is also reduced very easily. Additionally, as seen from the above, a space or cavity for collecting gas mixture before ignition can be spared more easily by this structure than by the conventional.

Also, according to the invention, the top of the center electrode and an end of the cylindrical hole of the ground electrode can be disposed nearly on the same plane so that a spark gap can be formed between the edge on the top of the center electrode and the edge on the circumference of the cylindrical hole of the ground electrode. Therefore, the whole of the cylindrical hole can be used effectively for the growth of ignition seeds. Other than that, if necessary, the outside size of the ground electrode can be made small with the capacity of the cylindrical hole kept unchanged.

Also, according to the invention, the top portion of the center electrode can be put in the cylindrical hole of the ground electrode in such a way as to form a spark gap in a wide region between the side surface of the center electrode and the inside surface of the cylindrical hole of the ground electrode. Therefore, sparks can appear in a wide space between both the electrodes, and this prolongs the life of the electrodes, lessening their wearing off by sparks.

Also, according to the invention, part of the cylindrical hole of the ground electrode can be whittled away parallel to the axial line of the center electrode in such a way as to increase the capacity of the cylindrical hole to hold gas mixture in. Therefore, even if the thickness of the ground electrode along the axial line is small, the capacity of the cylindrical hole can be increased according to the displacement and the shape of an engine, without sacrificing a good capacity of the ignition plug.

Further, according to the invention, a conical element can be provided to an end of the cylindrical hole of the ground electrode on the piston side in order that combustion gas can jet therethrough more widely. Therefore, the capacity of the ignition plug for ignition and combustion can be varied according to the variety and the displacement of an engine.

Also, according to the invention, the cylindrical ground electrode can be divided into two parts in such a way as to give an opening across the line connecting the stays, respectively. Therefore, expanding combustion gas can jet in diverse directions so as to improve the propagation of ignition seeds and increase the ignitability of the gas mixture.

Also, according to the invention, sparks can be formed in the spark gap generally extending perpendicular to the axial line of the center electrode in such a way as to let ignition seeds appear inside an end of the cylindrical hole of the ground electrode far from the piston. Therefore, combustion gas in the cylindrical hole gushes out not only toward the piston but also alongside the center electrode through the spark gap, bouncing on the inside surface of the cylindrical hole and the top surface of the center electrode, whereby ignition seeds can rapidly multiply over the combustion chamber and combustion happens instantaneously.

What is claimed is:

1. An ignition plug for an internal combustion engine comprising a housing; a cylindrical high-tension center electrode extending axially from said housing and having a substantially flat outer axial face and a radial face; a substantially annular ground electrode having a central axis, an inner annular surface and a first and second substantially flat axial face; wherein said ground electrode is axially spaced from said housing by a pair of legs extending axially from said housing, and is coaxial with said center electrode, said first axial face of said ground electrode disposed in a plane substantially the same as a plane of said axial end of the center electrode, wherein said annular inner surface of said ground electrode defines four substantially truncated triangular-shaped recesses equally spaced apart thereby defining a fuel ignition area and the annular inner surface between said recesses define a spark gap between the center electrode and the ground electrode.

2. A method of igniting a gas mixture in an internal combustion engine including the spark plug according to claim 1, comprising applying a high tension current to said center electrode whereby fuel in said spark gap ignites fuel retained in said recess.

3. An ignition plug for an internal combustion engine comprising a housing, a cylindrical high tension center electrode extending axially from said housing and having a substantially flat outer axial face and a radial face, a pair of opposing ground electrodes cooperating with said center electrode to define a spark gap, each of said ground electrodes having an arcuate shape and at least one substantially concave inner surface complementing the radial face of said center electrode and being disposed substantially parallel thereto to define a spark gap, each ground electrode having at least one recess on an inner surface contiguous with said concave inner surface to define a fuel ignition area.

4. The ignition plug of claim 3 wherein said pair of ground electrodes are disposed on opposite sides of said center electrode.

5. The ignition plug of claim 3 wherein said pair of ground electrodes are disposed to define a substantially annular ring having an axis disposed coaxially to said center electrode.

6. The ignition plug of claim 3 wherein said concave inner surface of each of said ground electrodes is positioned substantially at a midpoint of said ground electrode.

7. The ignition plug of claim 6 wherein each ground electrode is provided with two recesses disposed on opposite sides of said concave inner surface.

8. The ignition plug of claim 7 wherein said recesses have a substantially arcuate shape complementing the axial face of said center electrode and being substantially parallel thereto.

9. The ignition plug of claim 3 wherein said ground electrodes are spaced from said housing by a leg means extending axially from said housing.

10. The ignition plug of claim 3 wherein each of said ground electrodes are axially spaced from said center electrode.

11. The ignition plug of claim 3 wherein said ground electrodes are spaced radially outward from said center electrode.

12. The ignition plug of claim 3 wherein end surfaces of each of said arcuate-shaped ground electrodes cooperate with an end surface of the adjacent ground electrode whereby adjacent end surfaces define a substantially V-shaped opening between each ground electrode.

13. The ignition plug of claim 2 wherein each of said arcuate-shaped ground electrodes are provided with two substantially concave inner surfaces complementing the radial face of said center electrode to define two spark gaps between the center electrode and the ground electrode.

14. The ignition plug of claim 13 wherein each ground electrode includes a recess disposed between the concave inner surfaces to define a fuel combustion area.

15. The ignition plug of claim 14 wherein said recess is substantially triangular shaped.

16. The ignition plug of claim 14 wherein said recess is a substantially truncated triangle shape.

17. The ignition plug of claim 14 wherein said recess is a substantially semi-circular-shaped recess.

18. An ignition plug for an internal combustion engine comprising a housing; a cylindrical high tension center electrode extending axially from said housing, said center electrode having a substantially flat axial end facing opposite said housing; a substantially annular ground electrode having a central axis, means to define a substantially square aperture axially disposed in the ground electrode and having four orthogonal inner sides, and a first and second substantially flat axial face; wherein said ground electrode is axially spaced from said housing and is coaxial with said center electrode, said first axial face of said ground electrode disposed in a plane substantially the same as a plane of said axial end of the center electrode, and wherein at least a portion of each of said inner orthogonal sides is provided with a concave surface having a curvature complementing the axial face of the center electrode and radially spaced therefrom to define a spark gap therebetween, and a surface area adjacent said curvature to define a fuel ignition area.

19. An ignition plug for an internal combustion engine comprising a housing; a cylindrical high-tension center electrode extending axially from said housing and having a substantially flat outer axial face and a radial face; a substantially annular ground electrode having a central axis, an inner annular surface and a first and second substantially flat axial face; wherein said ground electrode is axially spaced from said housing by a pair of legs extending axially from said housing and is coaxial with said center electrode, said first axial face of said ground electrode disposed whereby the axial end is positioned radially inward of said annular inner surface, wherein said annular inner surface of said ground electrode includes a plurality of substantially truncated triangular-shaped recesses equally spaced apart thereby defining a fuel ignition area and the annular inner surface between said recesses define a spark gap between the center electrode and the ground electrode.

* * * * *